US007362208B2

(12) United States Patent
Yoshikawa et al.

(10) Patent No.: US 7,362,208 B2
(45) Date of Patent: Apr. 22, 2008

(54) THERMAL PELLET TYPE THERMAL FUSE

(75) Inventors: Tokihiro Yoshikawa, Koka (JP); Masahiro Nishikawa, Koka (JP)

(73) Assignee: NEC SCHOTT Components Corporation, Koka-shi (JP)

( * ) Notice: Subject to any disclaimer, the term of this patent is extended or adjusted under 35 U.S.C. 154(b) by 106 days.

(21) Appl. No.: 11/229,489

(22) Filed: Sep. 15, 2005

(65) Prior Publication Data

US 2007/0236324 A1 Oct. 11, 2007

(30) Foreign Application Priority Data

Sep. 17, 2004 (JP) ..... 2004-270785

(51) Int. Cl.
*H01H 37/76* (2006.01)
*H01H 85/06* (2006.01)

(52) U.S. Cl. ..... 337/416; 337/407; 337/401; 337/409; 337/388

(58) Field of Classification Search ..... 337/237, 337/227, 297, 232, 166, 404, 159, 160, 298, 337/401–405, 407, 290, 396, 416; 29/623
See application file for complete search history.

(56) References Cited

U.S. PATENT DOCUMENTS 3,180,958 A * 4/1965 Merrill ..... 337/409
3,281,559 A 10/1966 Ebensteiner
3,529,270 A * 9/1970 Kozacka ..... 337/232
3,727,164 A 4/1973 Cartier et al.
3,781,737 A 12/1973 Henry
3,815,071 A * 6/1974 Sleeter ..... 337/215
3,930,215 A * 12/1975 Senor ..... 337/407
4,001,754 A 1/1977 Plasko
4,065,741 A * 12/1977 Sakamoto et al. ..... 337/407
4,068,204 A * 1/1978 Iwanari et al. ..... 337/408
4,084,147 A 4/1978 Mlyniec et al.
4,184,139 A 1/1980 Hara
4,189,697 A 2/1980 Hara
4,259,656 A 3/1981 Smith
4,276,531 A 6/1981 Davis
4,276,532 A * 6/1981 Aoki ..... 337/408
4,281,309 A * 7/1981 Olson ..... 337/409
4,286,248 A * 8/1981 Hara ..... 337/403
4,322,705 A 3/1982 Hara
4,384,267 A 5/1983 Aoki (Continued)

FOREIGN PATENT DOCUMENTS

DE 24 57 223 10/1975

(Continued)

*Primary Examiner*—Anatoly Vortman
*Assistant Examiner*—Bradley H Thomas
(74) *Attorney, Agent, or Firm*—W. F. Fasse; W. G. Fasse

(57) ABSTRACT

In order to prevent erroneous operation caused by shrinking of a thermal pellet due to sublimation or softening of the thermal pellet when current is applied, a thermal pellet type thermal fuse includes a metal casing, a first lead and a second lead leading out from the metal casing, a movable electrode, a thermal pellet, a strong compression spring, and a weak compression spring. Difference in temperature is achieved at the surface of the metal casing by selecting different diameters or wires for the first lead and the second lead, or by providing a heat-radiating plate.

11 Claims, 1 Drawing Sheet

U.S. PATENT DOCUMENTS

| | | | | |
|---|---|---|---|---|
| 4,480,247 | A | | 10/1984 | Hara |
| 4,514,718 | A | | 4/1985 | Birx |
| 4,529,957 | A | * | 7/1985 | Hara ..... 337/407 |
| 4,630,023 | A | | 12/1986 | Gawron et al. |
| 4,821,010 | A | | 4/1989 | Plasko |
| 4,973,932 | A | | 11/1990 | Krueger et al. |
| 5,357,234 | A | | 10/1994 | Pimpis et al. |
| 5,473,303 | A | | 12/1995 | Hohider |
| 5,532,030 | A | | 7/1996 | Hirose et al. |
| 5,612,663 | A | | 3/1997 | Hollweck |
| 6,440,492 | B1 | | 8/2002 | Coran |
| 6,673,257 | B1 | | 1/2004 | Hudson |
| 6,710,310 | B2 | | 3/2004 | Hantz |
| 6,982,112 | B2 | | 1/2006 | Coran |
| 2003/0112117 | A1 | | 6/2003 | Miyashita et al. |
| 2003/0220460 | A1 | | 11/2003 | Merfeld |
| 2005/0088272 | A1 | | 4/2005 | Yoshikawa |
| 2005/0179516 | A1 | | 8/2005 | Yoshikawa |
| 2006/0208845 | A1 | | 9/2006 | Yoshikawa |

FOREIGN PATENT DOCUMENTS

| | | | | |
|---|---|---|---|---|
| EP | 1 120 432 | | | 8/2001 |
| EP | 1 308 974 | | | 5/2003 |
| GB | 2 011 724 | | | 7/1979 |
| JP | 50-138354 | | | 11/1975 |
| JP | 51-145538 | | | 11/1976 |
| JP | 52-144046 | | | 12/1977 |
| JP | 57-094142 | | | 6/1982 |
| JP | 57-103647 | | | 6/1982 |
| JP | 57-140034 | | | 9/1982 |
| JP | 60-138819 | | | 7/1985 |
| JP | 62-246217 | | | 10/1987 |
| JP | 02-281525 | | | 11/1990 |
| JP | 05-135649 | | | 6/1993 |
| JP | 05-307925 | | | 11/1993 |
| JP | 6-12594 | | | 3/1994 |
| JP | 2551754 | | | 8/1996 |
| JP | 09-282992 | | | 10/1997 |
| JP | 10-177833 | | | 6/1998 |
| JP | 11-111135 | | | 4/1999 |
| JP | 11-238440 | | | 8/1999 |
| JP | 2001-049092 | | | 2/2001 |
| JP | 2002-163966 | | | 6/2002 |
| JP | 2003-317589 | | | 11/2003 |
| JP | 2003317590 | A | * | 11/2003 |
| JP | 2004095524 | A | * | 3/2004 |
| JP | 2004-119255 | | | 4/2004 |
| KR | 2004-101534 | | | 12/2004 |

* cited by examiner

THERMAL PELLET TYPE THERMAL FUSE

BACKGROUND OF THE INVENTION

1. Field of the Invention

The present invention relates to a thermal fuse employing a thermal pellet, particularly a thermal pellet type thermal fuse with means for suppressing sublimation of the thermal pellet.

2. Description of the Background Art

Thermal fuses are used to protect household and industrial electronic/electrical apparatuses from damage caused by excessive heat. The thermal fuse has a compact and sturdy structure with the capability of cutting off circuitry promptly in the event of detecting an abnormal increase in temperature in order to avoid damage of the apparatus and fire disaster. With respect to the wide range of the nominal current ratings of 0.5 A to 15 A, usage of a thermal pellet type thermal fuse employing a thermal pellet for the thermal element is recommended for applications involving a high current of 6 A and above. A typical structure of a thermal pellet type thermal fuse includes a thermal pellet that is formed by molding insulative chemical material, which is hermetically sealed in a metal casing together with a movable electrode, weak and strong springs, and the like, and has a lead output from the casing. For example, Japanese Utility Model Laying-Open No. S57-94142 discloses a thermal pellet type thermal fuse that has a compression spring arranged at the thermal pellet side with a disk therebetween in a metal casing, and a barrel inserted to form close contact at the front peripheral portion in view of the problem that a thermal pellet type thermal fuse operates erroneously at a temperature lower than a predetermined operating temperature. Japanese Utility Model Laying-Open No. S57-103647 discloses a structure in which two pressure plates sandwiching a resilient ring therebetween are disposed between a thermal pellet and a strong compression spring in a metal casing. Japanese Patent Laying-Open No. 2004-119255 discloses a structure in combination with a thermal pellet of an insulating material that does not sublime in order to suppress sublimation of the thermal pellet.

Thermal-sensing materials include materials that easily sublime such as pure chemical agents and materials that do not easily sublime such as thermoplastic resin. A thermal pellet is fabricated by granulating powder of a thermal-sensing substance, and molding the granules into a predetermined shape. In the case where the sublimation action is relatively great or where deformation by shrinking or softening readily occurs, the pellet may be deformed prior to arriving at a predetermined operating temperature, leading to erroneous operation. Particularly in a current flowing state of usage, facilitation of sublimation of the thermal pellet may be expected at an ambient temperature lower than the predetermined operating temperature. It has been desired to alleviate such detrimental factors.

SUMMARY OF THE INVENTION

In view of the foregoing, an object of the present invention is to provide a novel and improved thermal pellet type thermal fuse, directed to heat generation of a lead that becomes a current path as means for suppressing sublimation of the thermal pellet caused by heat generated when current is applied.

In consideration of appropriately selecting respective conditions in order to prevent the thermal pellet from shrinking or being softened due to sublimation depending upon the storage conditions and environmental conditions, an object of the present invention is to provide a novel and improved thermal pellet type thermal fuse employing a specific structure in association with suppressing or preventing sublimation and softening of the thermal pellet when heated by the current flowing through the thermal fuse in an energization mode.

The present invention provides a thermal pellet type thermal fuse including a cylindrical metal casing to which first and seconds leads are attached, and a switching component having a movable electrode at the first lead side, a thermal pellet that is deformed by heat during a heating stage at the second lead side, and strong and weak springs urging the movable electrode and thermal pellet, incorporated in the metal casing. The thermal pellet is deformed at a predetermined temperature. The thermal fuse has the current path between the two leads switched between a conducting state and a cutoff state by the contact or non-contact between the first lead and the movable electrode. The thermal pellet type thermal fuse is characterized in that heat generation or heat radiation of the first lead and the second lead is set different from each other, whereby the surface temperature of the metal casing is set to be lower at the second lead side than at the first lead side. Namely, there is provided a thermal pellet type thermal fuse including a cylindrical metal casing incorporating a switching component, and a lead member leading out from both end sides of the metal casing, the lead member having a first lead attached to the metal casing by hermetic sealing with an insulating material, and a second lead fixed directly by caulking to the metal casing, and the switching component having a weak compressing spring, a movable electrode, a strong compression spring, and a thermal pellet sequentially disposed in the metal casing in order from the first lead side. At ordinary temperature, the urging force of the compression springs pressing the first lead and the movable electrode into contact is effected. The thermal fuse has an operating temperature to establish an open state between the first lead and the movable electrode through deformation of the thermal pellet by heating. The thermal pellet type thermal fuse is characterized in that materials having different physical or chemical properties are selected for the first lead and the second lead of the lead member to exhibit heat generation or heat radiation differing from each other. Accordingly, an erroneous operation prior to achieving the operating temperature of the thermal pellet can be prevented. Specifically, heat generation is set different by altering the conductivity between the first and second leads of the lead member. Further, heat radiation at the second lead side can be increased by absence/presence of heat radiating means. Difference in the surface temperature of the metal casing can be realized by, for example, setting the diameter of the first lead smaller than the diameter of the second lead when wires of the same conductivity are used, selecting wire of a material differing in conductivity when wires of the same diameter are used, or by a combination thereof. Further, heat radiating means can be employed at the second lead side as means for adjusting the surface temperature difference of the metal casing. Such means can be combined with the measures set forth above.

The present invention provides an improved thermal pellet type thermal fuse that prevents erroneous operation caused by heat generated from the lead member when current is applied to the thermal fuse. When a predetermined current flows, the heat generation or heat radiation of one lead is set different from the heat generation or heat radiation of the other lead to achieve difference in temperature at the surface of the case of the thermal fuse, whereby deformation caused by sublimation or softening of the thermal pellet is suppressed. Such a structure is particularly effective in the case where a chemical substance that exhibits significant sublimation at a temperature lower than the melting temperature is employed for the temperature-sensing material. The structure of the present invention allows the metal casing surface temperature to be lowered at the thermal pellet side. Setting different conductivity for the leads can be realized relatively easily, and is advantageous from the industrial perspective with little adverse effect on the processing steps and mass production in the fabrication aspect.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is directed to preventing erroneous operation of a thermal pellet type thermal fuse in association with shrinkage of the pellet caused by sublimation or softening of the thermal pellet when current is applied. The thermal pellet type thermal fuse includes a metal casing, first and second leads of a lead member leading out from the metal casing, and also a movable electrode, a thermal pellet, a strong compression spring, a weak compression spring, and first and second pressure plates, stored in the metal casing. Temperature difference is effected at the surface of the metal casing by using materials differing in physical or chemical properties such as different diameters and/or different wires for the first lead passing through an insulated bushing at one end side opening of the metal casing and the second lead fixed by caulking at the other end side opening of the metal casing, or by providing heat radiating means. In other words, the thermal pellet type thermal fuse includes a cylindrical metal casing incorporating a switching component, and a lead member leading out from both end sides of the metal casing. The lead member includes a first lead attached to the metal casing by hermetic sealing with an insulating material, and a second lead fixed directly by caulking to the metal casing. The switching member includes a weak compression spring, a movable electrode, a strong compression spring, and a thermal pellet sequentially disposed in the metal casing in order from the first lead side. At ordinary temperature, the urging force of the compression springs that presses the first lead and the movable electrode into contact is effected. The thermal fuse has an operating temperature that establishes an open state between the first lead and the movable electrode by deformation of the thermal pellet caused by heating. Materials having different physical or chemical properties are selected for the first lead and the second lead of the lead member to exhibit heat generation or heat radiation differing from each other. Thus, a thermal pellet type thermal fuse is provided having the surface temperature of the metal casing set lower at the second lead side than at the first lead side.

EXAMPLES

Figure 1:
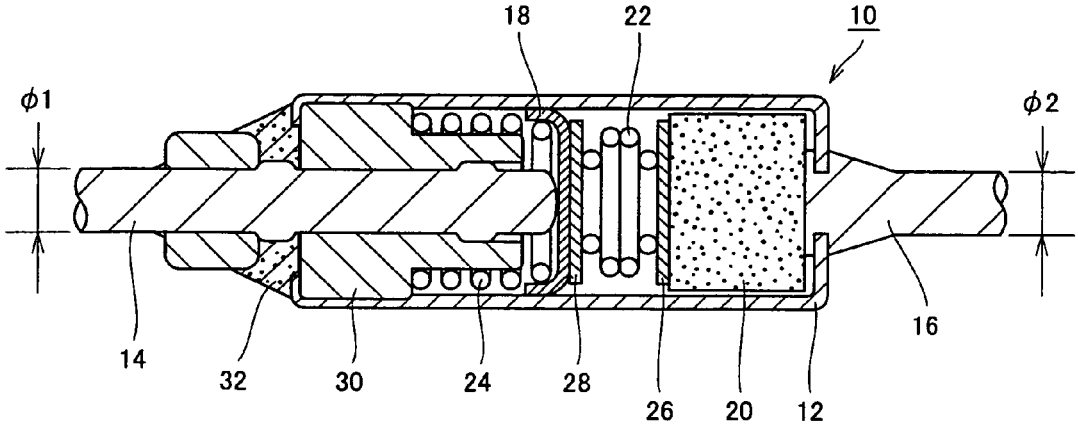
FIG. 1 is a longitudinal sectional view of a thermal pellet type thermal fuse in a normal state according to an embodiment of the present invention.
Figure 2:
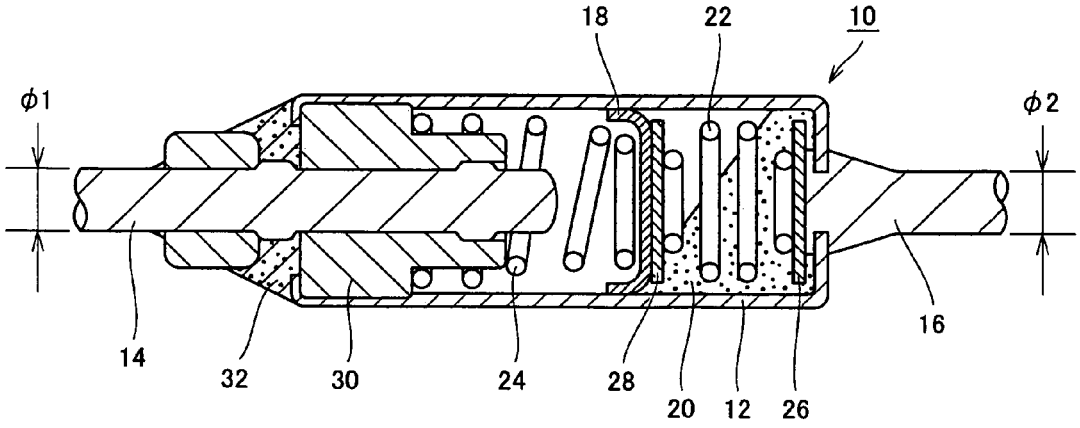
FIG. 2 is a longitudinal sectional view of a thermal pellet type thermal fuse subsequent to operation according to an embodiment of the present invention.

Examples of a thermal pellet type thermal fuse of the present invention will be described in detail hereinafter with reference to FIGS. 1 and 2. A thermal pellet type thermal fuse 10 includes a metal casing 12 favorable in conductivity and heat conductance, qualified as the main body, two leads 14 and 16 of a lead member leading out from metal casing 12, and also a movable electrode 18 of a switching member, a thermal pellet 20, a strong compression spring 22, a weak compression spring 24, and two pressure plates 26 and 28, stored in metal casing 12. An opening at one end side of cylindrical metal casing 12 is blocked by an insulating bushing 30 through which first lead 14 passes, and is hermetically sealed with sealing resin 32. Metal casing 12 has an opening at the other end side closed by fixing one end of second lead 16 through caulking. In such a structure, a nickel wire of 1.0 mm in diameter was employed for first lead 14, whereas a copper wire of 1.0 mm in diameter was employed for second lead 16, as shown in Example 8 in Table 1 that will be described afterwards. With regards to a thermal pellet type thermal fuse produced by the conditions set forth above, the reduction of the thermal pellet in dimension subsequent to applying current of 20 A for 500 hours was 14%. This result indicates that the thermal pellet reduction of the present invention was lowered to approximately ¼ as compared to the reduction of 60% for a conventional thermal pellet type thermal fuse employing copper wires of 1.0 mm in diameter for both leads. Although the conductivity is set different between first and second leads 14 and 16 by using different materials in the present invention, leads of the same material with different diameters may be used instead. Accordingly, the heat generated by the current flowing through the leads during usage causes difference in the surface temperature of metal casing 12. In addition to the selection of the material and the diameter of the wire to cause difference in surface temperature of the metal casing, an appropriate heat-radiating plate can be provided at the second lead for the adjustment.

In order to evaluate the effect of the present invention, inventive examples of thermal fuses of ten types, as shown in Table 1, based on different materials and diameters for the leads as well as with or without a heat-radiating plate were fabricated for testing. Furthermore, prototypes including three conventional examples and comparative examples were fabricated. All the prototypes were subjected to comparative testing, in which the reduction in dimension of the thermal pellet 20 was measured. On the basis of the tests of the thermal fuses fabricated with leads corresponding to various conditions, respective test items had the advantage of the present invention numerically represented by measuring the pellet size reduction at predetermined testing conditions.

TABLE 1

| | First Lead 14 | | Second Lead 16 | | Presence of | Pellet Reduction |
|---|---|---|---|---|---|---|
| | φ1 (mm) | Material | φ2 (mm) | Material | Heat-radiating plate | (%) |
| Conventional Example 1 | 1.0 | Copper | 1.0 | Copper | No | 60 |
| Conventional Example 2 | 1.2 | Copper | 1.2 | Copper | No | 50 |
| Conventional Example 3 | 1.5 | Copper | 1.5 | Copper | No | 43 |
| Example 1 | 1.0 | Copper | 2.0 | Copper | No | 5 |
| Example 2 | 1.0 | Copper | 1.5 | Copper | No | 15 |
| Example 3 | 1.0 | Copper | 1.2 | Copper | No | 40 |
| Example 4 | 1.0 | Copper | 2.0 | Copper | Yes | 1 |
| Example 5 | 1.0 | Copper | 1.5 | Copper | Yes | 4 |
| Example 6 | 1.0 | Copper | 1.2 | Copper | Yes | 12 |
| Example 7 | 1.0 | Iron | 1.0 | Copper | No | 15 |
| Example 8 | 1.0 | Nickel | 1.0 | Copper | No | 14 |
| Example 9 | 1.0 | Nickel | 1.0 | Copper | Yes | 3 |
| Example 10 | 1.0 | Nickel | 1.5 | Copper | Yes | 1 |
| Comparative Example 1 | 1.0 | Copper | 1.0 | Iron | No | 100 |
| Comparative Example 2 | 1.0 | Copper | 1.0 | Nickel | No | 100 |
| Comparative Example 3 | 1.5 | Copper | 1.0 | Nickel | No | 100 |

Testing Conditions:

A current of 20 A was applied to a thermal pellet type thermal fuse suspended in air in a condition in which a temperature difference readily occurs. The fuse was taken out after 500 hours, and the reduction in dimension of the thermal pellet was measured, represented as:

Reduction=100−dimension after testing/initial dimension×100

The heat-radiating plate was a copper plate of 0.2 mm in thickness, 20 mm in width, and 40 mm in length in contact at the lead 16 side.

It is appreciated from the above table that the thermal pellet of Conventional Example 1 exhibited a dimension reduction of 60%, and Conventional Examples 2 and 3 with larger diameters exhibited a reduction of 50% and 43%, respectively. In comparison, Examples 1-10 of the present invention all exhibited a reduction of 40% at most. The test results of the present invention are represented corresponding to the case where the diameter of the second lead was simply increased for Examples 1 and 3, the case where a copper heat-radiating plate qualified as heat radiating means was attached on the side of the second lead 16 for Examples 4-6, the case where the material of the wires was changed for Examples 7 and 8, the case where a heat-radiating plate was additionally attached thereto for Example 9, and the case where the diameter was changed for Example 10. It is appreciated that all the examples according to the present invention had pellet shrinkage suppressed as compared to the conventional examples. The test items of Comparative Examples 1-3 correspond to the case where the first lead had a conductivity lower than that of the second lead. They are all outside the range of interest of the present invention, and indicative of complete deformation by sublimation or softening. The reduction value of 100% implies that the thermal fuse operates erroneously prior to arriving at the predetermined operating temperature.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermal pellet type thermal fuse comprising: a cylindrical metal casing incorporating a switching component, and a lead member leading out from both end sides of said metal casing, said lead member including a first lead attached to said metal casing by hermetic sealing with an insulating material, and a second lead fixed directly by caulking to said metal casing, said switching component including a weak compression spring, a movable electrode, a strong compression spring, and a thermal pellet sequentially disposed in order from a side of said first lead in said metal casing, an urging force of the compression springs pressing said first lead and said movable electrode into contact at an ordinary temperature, said thermal fuse having an operating temperature establishing an open state between said first lead and said movable electrode by deformation of said thermal pellet caused by heating, wherein materials having different physical or chemical properties are respectively selected for said first lead and said second lead of said lead member to exhibit heat generation or heat radiation differing from each other, and wherein said lead member has said materials selected such that a surface temperature of said metal casing is lower at a side of said second lead than at said side of said first lead when a current is applied, whereby sublimation of said thermal pellet is suppressed and erroneous operation prior to achieving said operating temperature is prevented.

2. The thermal pellet type thermal fuse according to claim 1, wherein said lead member has said first lead and said second lead set to have conductivity differing from each other.

3. The thermal pellet type thermal fuse according to claim 2, wherein said first lead and said second lead employ wires of a diameter differing from each other.

4. The thermal pellet type thermal fuse according to claim 2, wherein said first lead and said second lead employ wires having conductivity differing from each other.

5. A thermal fuse comprising:

a cylindrical metal casing;

a first lead extending into a first end of said casing through an interposed insulating bushing;

a second lead electrically conductively connected to a second end of said casing opposite said first end;

a thermal pellet of a thermosensitive material adapted to deform by a thermal deformation at an operating temperature above a normal temperature, wherein said thermal pellet is arranged in said casing proximate to said second end;

a movable conductive member arranged in said casing, electrically contacting said casing and positioned between said thermal pellet and said first lead; and a spring arrangement arranged in said casing and cooperating with said movable conductive member and with said thermal pellet so as to urge said movable conductive member into electrical contact with said first lead at said normal temperature before said thermal deformation of said thermal pellet and so as to move said movable conductive member out of electrical contact with said first lead when said thermal pellet undergoes said thermal deformation;

wherein said second lead has a higher electrical conductance than said first lead, wherein said second lead has a larger diameter than said first lead so as to provide or contribute to said higher electrical conductance, and/or said first lead and said second lead consist of different materials and said material of said second lead has a higher electrical conductivity than said material of said first lead so as to provide or contribute to said higher electrical conductance.

6. The thermal fuse according to claim 5, wherein said second lead has said larger diameter than said first lead so as to provide or contribute to said higher electrical conductance.

7. The thermal fuse according to claim 6, wherein said first lead and said second lead consist of said different materials, and said material of said second lead has said higher electrical conductivity than said material of said first lead so as to provide or contribute to said higher electrical conductance.

8. The thermal fuse according to claim 5, wherein said first lead and said second lead consist of said different materials, and said material of said second lead has said higher electrical conductivity than said material of said first lead so as to provide or contribute to said higher electrical conductance.

9. The thermal fuse according to claim 7, wherein said material of said second lead is copper and said material of said first lead is iron or nickel.

10. The thermal fuse according to claim 5, wherein said second end of said metal casing will exhibit a lower surface temperature than said first end of said metal casing due to said higher electrical conductance of said second lead compared to said first lead when a current is conducted through said first lead, said movable conductive member, said casing and said second lead.

11. The thermal fuse according to claim 5, wherein said second lead will exhibit a lower temperature than said first lead due to said higher electrical conductance of said second lead compared to said first lead when a current is conducted through said first lead, said movable conductive member, said casing and said second lead.

* * * * *